US006976591B2

(12) United States Patent
Reding

(10) Patent No.: US 6,976,591 B2
(45) Date of Patent: Dec. 20, 2005

(54) FOOD-STUFF PHYSICAL CHARACTERISTIC SORTING APPARATUS AND METHOD

(76) Inventor: Gary T. Reding, 3806 S. County Rd. 550 East, Greensburg, IN (US) 47240

( * ) Notice: Subject to any disclaimer, the term of this patent is extended or adjusted under 35 U.S.C. 154(b) by 377 days.

(21) Appl. No.: 10/633,067

(22) Filed: Aug. 1, 2003

(65) Prior Publication Data

US 2005/0035035 A1 Feb. 17, 2005

(51) Int. Cl.[7] ..... B07C 9/00
(52) U.S. Cl. ..... 209/692
(58) Field of Search ..... 209/691–693, 209/920, 921, 910, 365.1, 366, 339

(56) References Cited

U.S. PATENT DOCUMENTS

| | | | | | |
|---|---|---|---|---|---|
| 448,394 | A | * | 3/1891 | Wheelan | 209/692 |
| 483,986 | A | * | 10/1892 | Bacon | 209/705 |
| 817,901 | A | * | 4/1906 | Brantingham | 209/366 |
| 818,607 | A | * | 4/1906 | Brantingham | 209/366 |
| 1,114,935 | A | * | 10/1914 | Sutton et al. | 209/692 |
| 1,292,820 | A | * | 1/1919 | Lindsley | 209/692 |
| 1,320,169 | A | * | 10/1919 | Payne | 209/129 |
| 1,625,257 | A | * | 4/1927 | Ingolfsrud et al. | 209/223.2 |
| 1,791,291 | A | * | 2/1931 | Simpson | 209/332 |
| 2,305,344 | A | * | 12/1942 | Gary | 209/365 |
| 2,658,616 | A | | 11/1953 | Stutzman | |
| 2,788,124 | A | | 4/1957 | Miller | |
| 3,618,617 | A | * | 11/1971 | Gates et al. | 460/146 |
| 3,775,953 | A | * | 12/1973 | Poutsma | 56/126 |
| 3,782,545 | A | * | 1/1974 | Rayner et al. | 209/692 |
| 3,827,554 | A | * | 8/1974 | Richard | 209/44.3 |
| 3,978,986 | A | * | 9/1976 | Schmidt et al. | 209/692 |
| 4,078,663 | A | * | 3/1978 | Barker et al. | 209/693 |
| 4,107,035 | A | * | 8/1978 | Foresman | 209/309 |
| 4,301,931 | A | * | 11/1981 | Satake | 209/691 |
| 4,391,374 | A | * | 7/1983 | Krynock | 209/540 |
| 4,609,110 | A | * | 9/1986 | Schulman et al. | 209/663 |
| 4,760,925 | A | | 8/1988 | Stehle et al. | |
| 4,793,918 | A | * | 12/1988 | Thomas | 209/467 |
| 5,199,575 | A | * | 4/1993 | McHugh | 209/522 |
| 5,802,965 | A | * | 9/1998 | Lin | 99/517 |
| 6,070,736 | A | * | 6/2000 | Ballman et al. | 209/325 |
| 6,530,203 | B2 | * | 3/2003 | Suzuki et al. | 56/327.2 |
| 6,758,342 | B1 | * | 7/2004 | Harada | 209/707 |

FOREIGN PATENT DOCUMENTS

| | | | | | |
|---|---|---|---|---|---|
| JP | 04267978 | A | * | 9/1992 | B07B 13/11 |
| JP | 05200363 | A | * | 8/1993 | B07B 13/11 |

* cited by examiner

*Primary Examiner*—Donald P. Walsh
*Assistant Examiner*—Matthew J. Kohner
(74) *Attorney, Agent, or Firm*—Thomas S. Baker, Jr.

(57) ABSTRACT

A foodstuff seed sorting endless belt conveyor apparatus for sorting out premium quality seeds from a seed mixture having both premium and inferior grade seeds on the basis of seed physical characteristics develops an orbital motion that is superimposed upon the normal longitudinal motion of the apparatus endless belt to thereby increase sorting selectivity, efficiency, and rates of product throughput.

14 Claims, 6 Drawing Sheets

FOOD-STUFF PHYSICAL CHARACTERISTIC SORTING APPARATUS AND METHOD

CROSS-REFERENCES

None.

FIELD OF THE INVENTION

This invention relates generally to the sorting of food-stuffs, and particularly concerns both endless belt conveyor apparatus and methods of endless belt conveyor apparatus operation that enable the sorting out or removal, by physical characteristics or properties, of food-stuff items of less-than-desirable shape (sometimes referred to as "trash") from a process flow of a mixture of both acceptable and unacceptable food-stuff shapes with greater selectivity, greater efficiency, and increased product throughput rates.

BACKGROUND OF THE INVENTION

Increasingly, customers for food-stuff seeds in the United States such as soy beans, black beans, garbanzo beans, etc. especially insist or require that the delivered end-product food-stuff seeds be of a "premium grade"—a grade that is visually, very nearly totally-free of included imperfectly formed (misshapen) seeds such as those seeds having flat surface areas, surface indentations and deformities, etc., and also be totally free of undersized seeds, of plant stems, rocks, stones, pellet-sized clumps of soil, and other matter. The unacceptable end product constituents are considered herein to be in the general category of "trash".

Both longitudinally and upwardly-pitched endless belt sorting conveyor apparatus and longitudinally and transversely downwardly-pitched endless belt sorting conveyor apparatus have been used in the United States for food-stuff shape-sorting purposes but such have not achieved adequate efficiency in achieving total removal of misshapen seeds from the delivered "premium grade" end-product to thereby satisfy market quality requirements.

I have discovered that by superimposing an orbital motion (i.e., circular, elliptical, etc. motion) upon the longitudinal motion of a longitudinally and transversely tilted endless belt seed sorter apparatus both the efficiency of misshapen seed removal from raw food-stock seed and the rate of seed processing may be significantly increased. Also, I have discovered that varying the surface finish of the sorter conveyor endless belt can in some instances further enhance sorting efficiency as in the case of meeting specific minimum seed size requirements.

Other objects and advantages of the present invention will become apparent during consideration of the detailed drawings, descriptions, and claims which follow.

SUMMARY OF THE INVENTION

The seed-sorting apparatus of the present invention is essentially comprised of a freely suspended compound frame, a motor-driven endless sorter belt conveyor assembly that is carried by an upper frame element of the compound frame, a manually-operated mechanism that imparts an adjustable upward longitudinal tilt to the upper frame element and the belt conveyor, a lower compound frame element that pivotally supports the upper frame element and its driven endless sorter belt, a manually-operated mechanism that imparts an adjustable transverse downward tilt to the conveyor assembly and its driven endless belt, and a motor-driven drive that imparts orbital (i.e., circular, elliptical, etc.) motion to the lower compound frame element of the freely suspended compound frame and the components that it carries to thus, from a method standpoint, superimpose an additional and particular lateral motion upon the longitudinal motion of the apparatus conveyor assembly endless sorter belt.

A seed feed hopper and also discharge chutes are typically included with the apparatus, and is some cases modifications are made to the surface of the conveyor endless sorter belt to further improve seed-sorting efficiency. Also, an alternate form of conveyor apparatus support to permit limited free lateral motion of the conveyor and its compound support frame assembly is contemplated.

DETAILED DESCRIPTION

Figure 1:
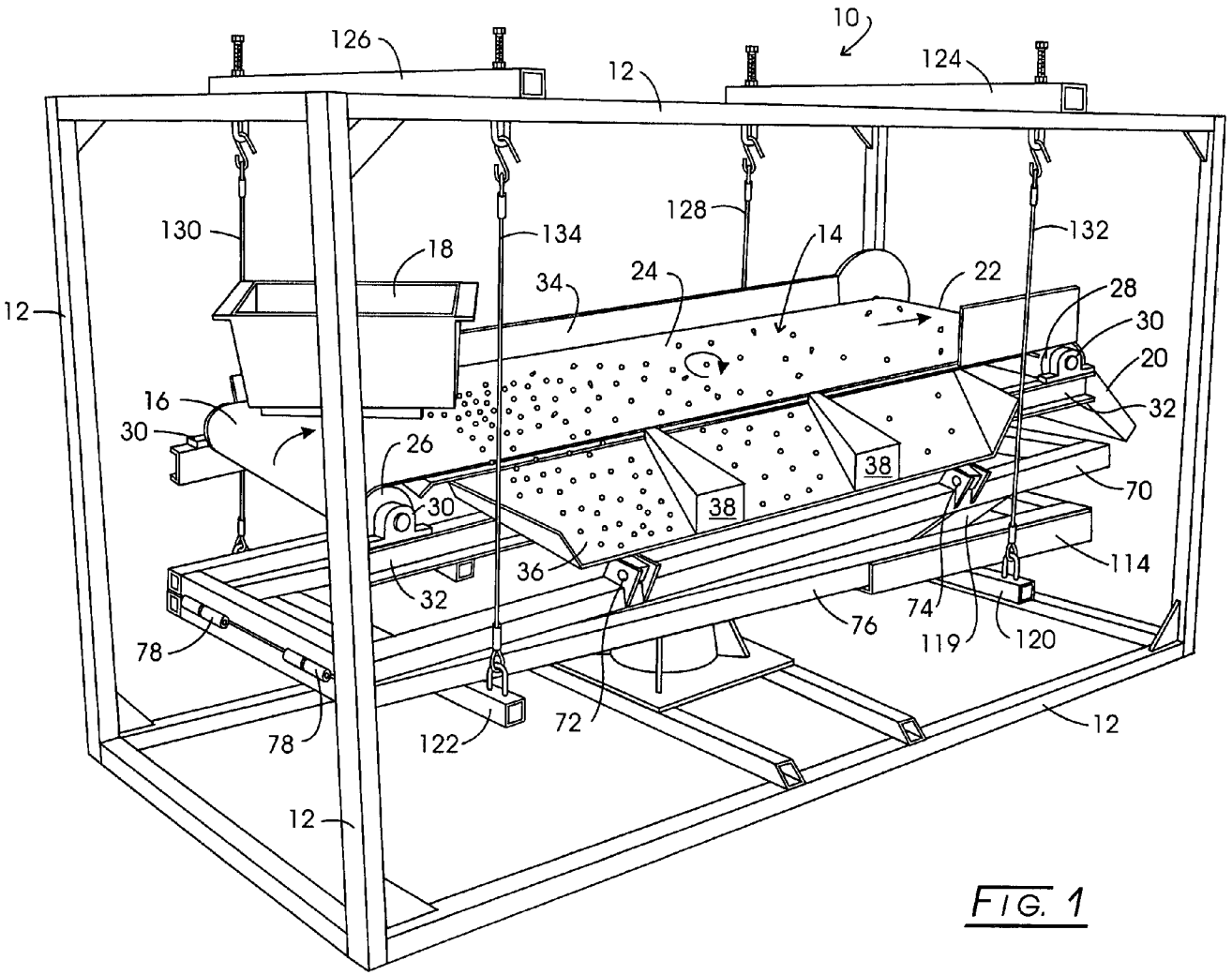
FIG. 1 is a schematic perspective view of a preferred embodiment of the improved endless belt food-stuff seed sorter apparatus assembly of the present invention.

Referring to FIGS. 1 through 5 of the drawings, the endless belt seed-sorting apparatus of the present invention is referenced generally as 10 and such is essentially situated within overall welded box-type suspension frame assembly 12. The assembly endless belt conveyor sub-assembly 14 has an inlet end 16 adjacent to feed hopper 18 and a first discharge chute 20 positioned adjacent to conveyor trash discharge end 22 The apparatus endless belt is designated 24. Endless belt 24 is supported by end rollers 26 and 28 each mounted in a pair of opposed pillow blocks 30 attached to and carried by conveyor sub-assembly spaced-apart support beams 32.

A shield or guard 34 extends along the rear longitudinal edge of conveyor sub-assembly 14 to prevent seed and other materials from falling off the rear side of the conveyor. A second discharge chute 36 is mounted adjacent the front edge of conveyor 14 to receive seed that have been sorted out for subsequent delivery to a customer or customers. A plurality of separator or cut-out blocks 38 divide second discharge chute 36 into sections to enable the sorted seeds to be graded according to different degrees of quality, if desired. Receiving containers (not shown) are positioned beneath second discharge chute 36.

Figure 2:
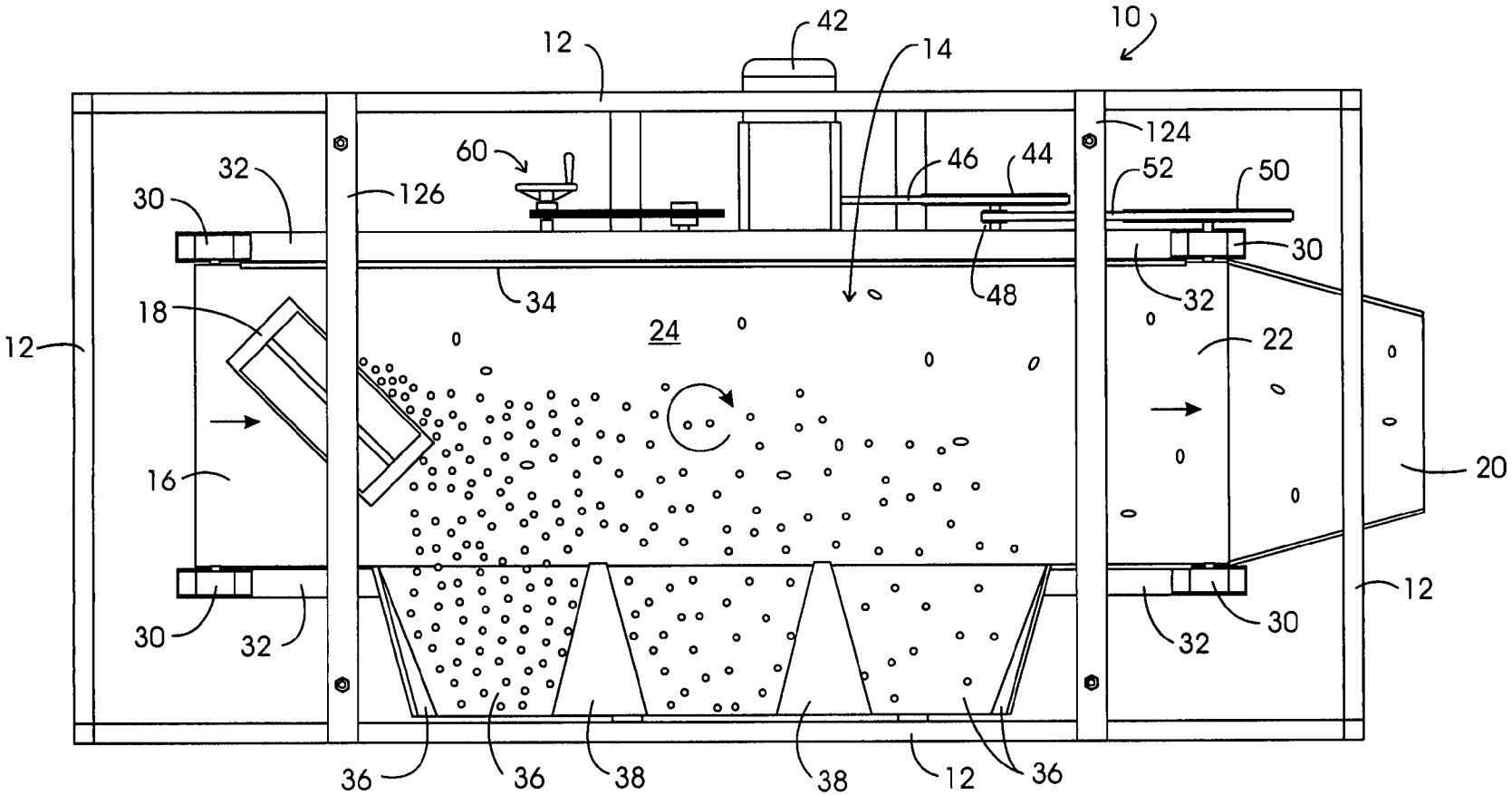
FIG. 2 is a plan view of the apparatus assembly of FIG. 1.
Figure 3:
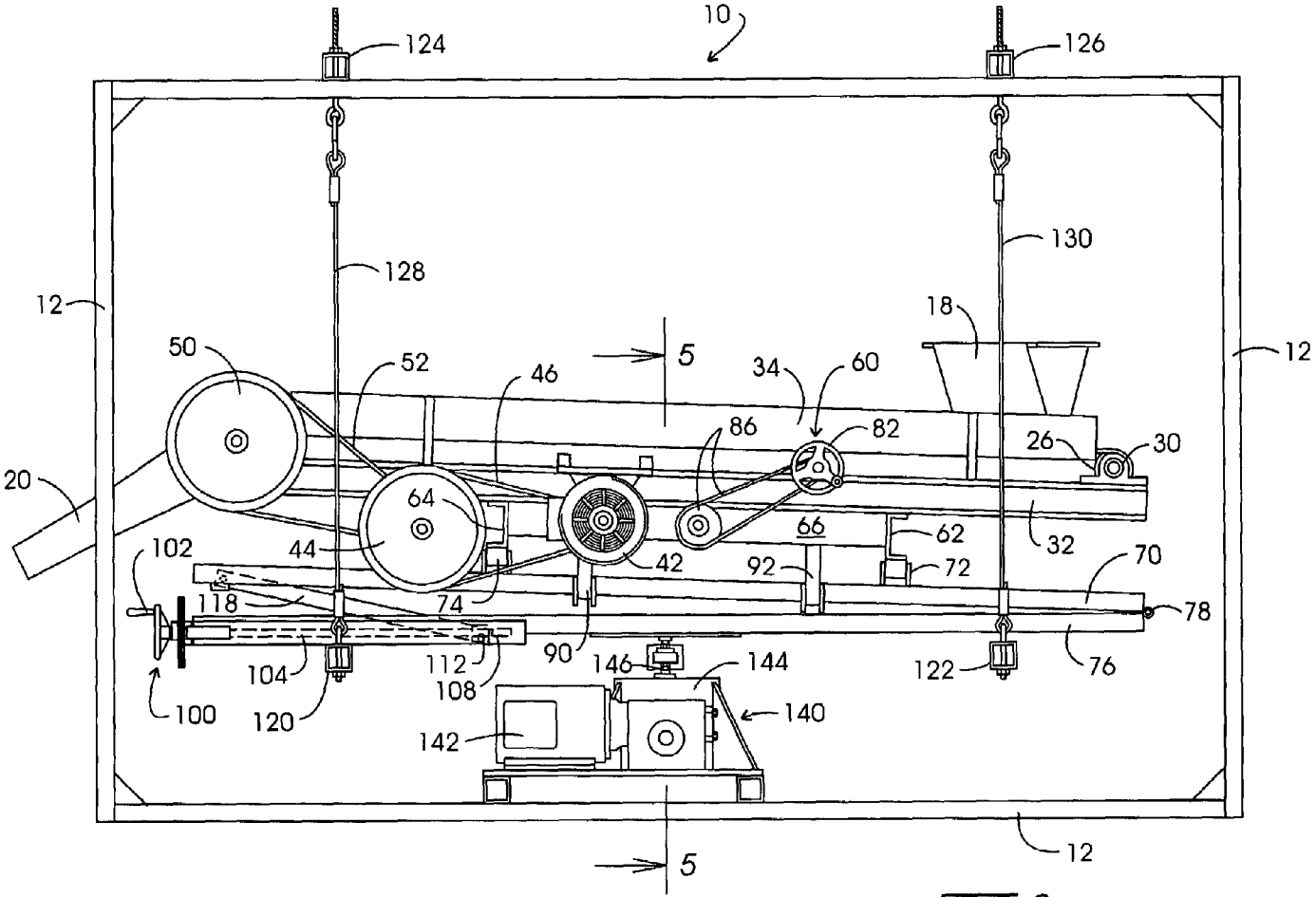
FIG. 3 is a rear elevation view of the apparatus assembly of FIG. 1.

Referring particularly to FIGS. 2 and 3, conveyor sub-assembly 14 is driven by an electric motor 42 connected to a drive pulley 44 by belt 46. A small pulley 48 is mounted on the same shaft as pulley 44 which acts as a speed reducer. Pulley 48 drives a pulley 50 that is driven by belt 52. Pulley 50 is affixed to the shaft of conveyor discharge-end roller 26.

During normal operation of apparatus 10 the back longitudinal edge of conveyor assembly 12 adjacent to shield 34 is elevated with respect to the front longitudinal edge of endless belt 24 adjacent to second discharge chute 36. A manually-operated transverse (lateral) tilt adjustment mechanism 60 is provided for operation to accomplish changing the elevation of the conveyor sub-assembly back edge relative to the uppermost edge of second discharge chute 36.

Figure 4:
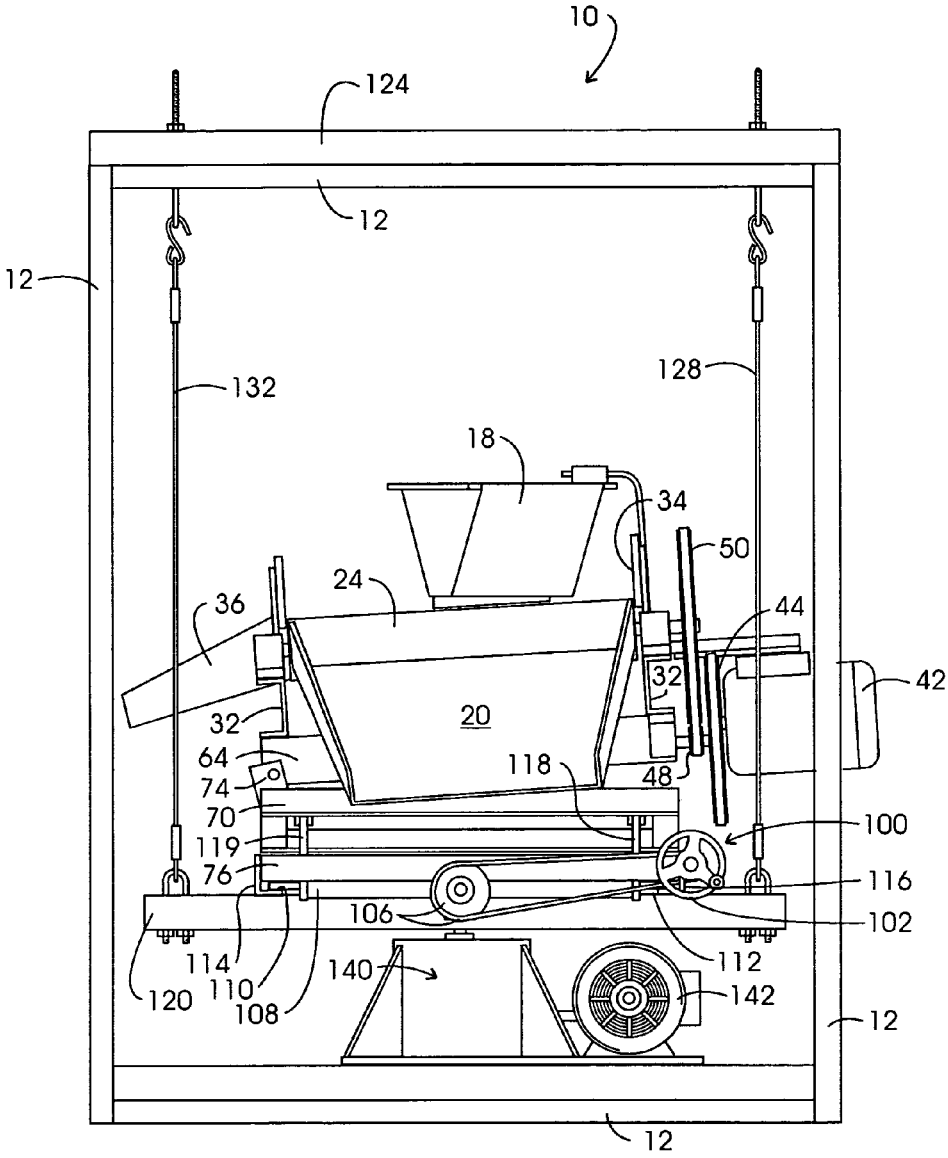
FIG. 4 is a discharge-end elevation view of the apparatus assembly of FIG. 1.
Figure 5:
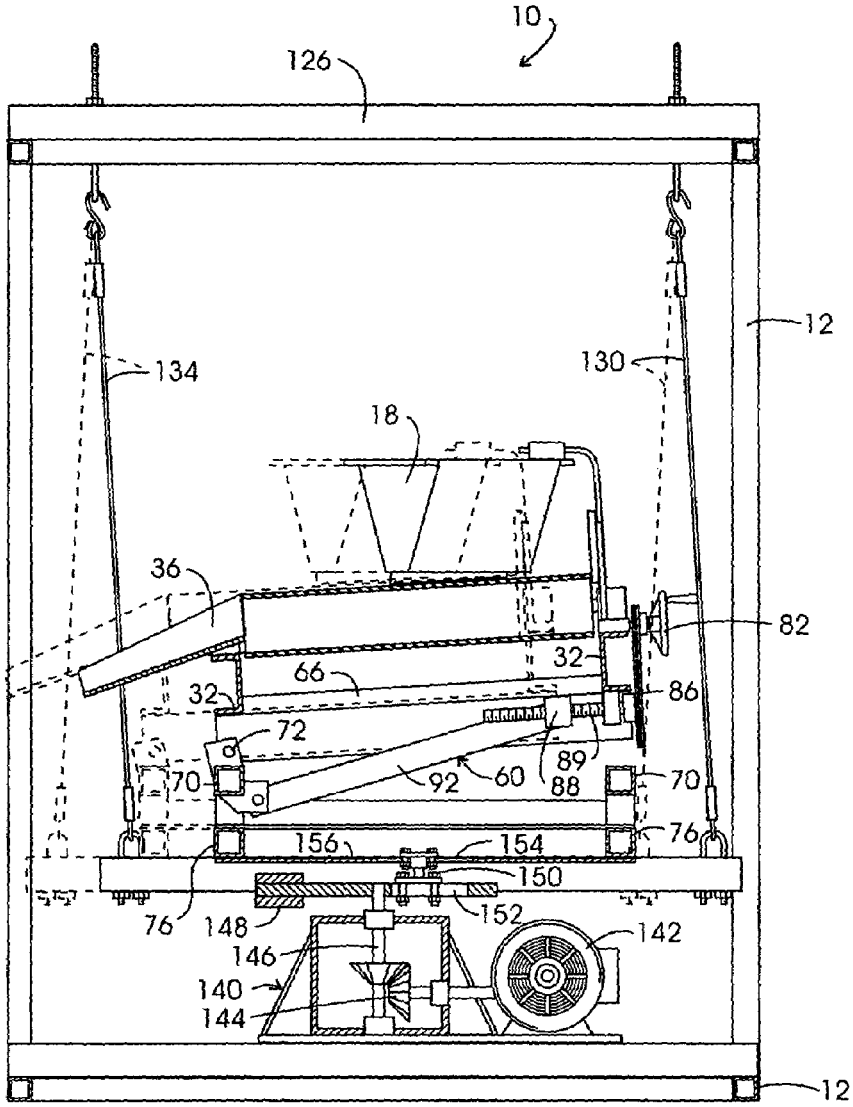
FIG. 5 is a schematic section view taken along line 5—5 of FIG. 3.

Referring to FIGS. 3 through 5, conveyor beam members 32 are joined to transverse frame element 62, 64, and a pair of parallel bars 66. Bars 66 extend between the bottom surfaces of conveyor frame beams 32 to just above the transverse frame members 62, 64. Transverse frame members 62, 64 are pivotally attached to an upper longitudinal frame member 70 by pivot connections 72 and 74, respectively. Upper longitudinal frame member 70 is pivotally connected to bottom longitudinal frame member 76 through a pivot connection 78 to enable the discharge end 22 of conveyor sub-assembly 14 to be adjustably elevated with respect to the inlet end 16 as will be described in detail below.

Transverse tilt adjustment mechanism 60 incorporates an adjustment wheel 82 which when rotated drives threaded shaft 84 by means of a chain and sprocket assembly 86. Threaded shaft 84 is mounted within a threaded bore of a cross member 88 which extends beneath and engages the parallel bars 66 which extend between conveyor frame members 30, 32 as stated above. A pair of transverse elevation links 90, 92 are pivotally attached at one end to cross member 88 and are pivotally attached at the other end to the upper longitudinal frame member 70. Rotation of manually-operated adjustment wheel 82 and threaded shaft 84 cause cross member 88 to slide along the bottom of bars 66 to thereby elevate or lower the back longitudinal edge of conveyor sub-assembly 14 with respect to the opposite front longitudinal edge. As mentioned previously, in normal operation of seed sorting apparatus assembly 10 the back longitudinal edge of conveyor sub-assembly 14 is elevated with respect to the front longitudinal edge. It may be observed that the load carried by cross member 88 is primarily transferred to transverse elevation links 90, 92 which in turn carry the load to upper longitudinal frame member 70. The degree of elevation inputted to the rear longitudinal edge of conveyor sub-assembly 14 relative to the front longitudinal edge is determined by the nature of the food-stuff seed material to be sorted.

As previously noted, normal operation of seed sorting apparatus 10 also involves elevating discharge end 22 of conveyor sub-assembly 14 relative to inlet end 16. Elevation adjustment of discharge end 22 is accomplished by a horizontal adjustment mechanism 100. Longitudinal tilt adjustment mechanism 100 utilizes a manually-operated longitudinal tilt adjustment wheel 102 to drive a longitudinally extending threaded screw 104 through a chain and sprocket mechanism 106. Threaded screw 104 is connected to a transverse cross member 108 having guide pins 110, 112 mounted at opposite ends thereof. Guide pins 110, 112 are captured in guide rails 114, 116 mounted on opposite sides at the discharge end of lower longitudinal elevation frame member 76. A pair of longitudinal elevation links 118, 119 are pivotally connected at one end to transverse cross member 108, and are pivotally connected at the other end to opposite sides of upper longitudinal frame member 70 adjacent discharge end 22.

Thus, as longitudinal tilt adjustment wheel 102 and screw 104 are rotated, transverse cross member 108 is reciprocated within guide rails 114, 116 to thereby extend or retract longitudinal elevation links 118, 119. Movement of longitudinal elevation links 118, 119 causes the discharge end of upper longitudinal frame member 70 to be raised or lowered as the case may be. As mentioned above, during conventional operation of sorting machine 10 the discharge end 22 of conveyor sub-assembly 14 must be elevated relative to inlet end 16. The degree of elevation inputted to the discharge end of conveyor sub-assembly 14 relative to the inlet end is determined by the nature of the seed material to be sorted.

Lower longitudinal frame member 76 rests upon a pair of spaced-apart parallel lateral suspension frame elements 120, 122. Each end of the transverse suspension frame element 120, 122 is connected to one end of a pair of upper transverse suspension frame members 124, 126 by cable elements 128 through 134 attached to a U-bolt at one end thereof and to an S-hook mounted in a U-bolt at the opposite end thereof. In this manner, upper and lower longitudinal frame members 70, 76 which support conveyor sub-assembly 14 including transverse tilt adjustment mechanism 60 and longitudinal adjustment mechanism 100 are freely suspended to allow limited, generally lateral planar movement of those components.

An orbital platform drive mechanism 140 is attached to the lower extreme of box frame 12 to cause limited orbital (i.e., circular, elliptical, etc.) movement of lower longitudinal frame member 76 and the many apparatus component parts that it supports. Orbital drive mechanism 140 utilizes an electric gear reduction motor assembly 142 which drives a beveled gear assembly 144. Beveled gear assembly 144 has a vertical output shaft 146 which is rigidly connected to a weighted plate element 148. (See FIG. 5). A slidable orbit adjustment mechanism 150 movable within a slot 152 formed in weighted plate 148 and another slot 154 within plate element 156 rigidly affixed to the lower surface of lower longitudinal frame member 76 serves to connect the two elements. Sliding adjustment mechanism 150 with the slot elements 152 and 154 changes the radial distance from vertical output shaft 146 of beveled gear assembly 144 and the connection to longitudinal frame member 76. By changing this distance, movement in a desired orbital path may be imposed to upper and lower longitudinal frame members 70, 76 and to conveyor sub-assembly 14 and its longitudinally moving endless belt 24 when electric gear reduction motor 142 is operated.

Preparation of seed sorting apparatus assembly 10 for operation commences with operating transverse tilt adjustment mechanism 60 by manually rotating adjustment wheel 82 and threaded shaft 84 to thereby properly set the height of rear longitudinal edge of conveyor sub-assembly 14 relative to the conveyor front longitudinal edge. For the purpose of sorting out "premium" soy beans from a conventional food-stuff supply of harvested soy beans I prefer utilization of a conveyor belt transverse angle of downward tilt of approximately 3½°. Thereafter, longitudinal tilt adjustment mechanism 100 is manually operated by rotating adjustment wheel 102 and screw element 104 to thereby properly adjust the height of the discharge end 22 of conveyor sub-assembly 14 relative to inlet end 16. Again, and for the purpose of sorting out "premium" soy beans from a conventional food-stuff supply of harvested soy beans, I prefer utilization of a conveyor belt longitudinal angle of upward tilt of approximately 4¼°. Referring to FIG. 1, after making the desired transverse and longitudinal tilt adjustments, the rear longitudinal edge of conveyor sub-assembly 14 will be at a higher level than the conveyor front longitudinal edge adjacent second discharge ramp 36. Additionally, the discharge end of conveyor sub-assembly 14 will be raised relative to inlet end 16 and feed hopper 18. Also, and with respect to the sorting out of "premium" soy beans from a conventional supply of harvested soy bean feed-stuff, I prefer a sorting apparatus orbital movement diameter of approximately 3⅝ inches, an orbital speed of rotation of approximately 70 to 80 revolutions per minute, and an endless belt longitudinal velocity of approximately 85 feet per minute. Under these operating conditions, and utilizing an endless conveyor belt that is approximately 7.5 feet end to end, the rate of product throughput for apparatus 10 was approximately 3,000 pounds of dry soy bean food-stuff per hour. With respect to sorting out other types of beans of larger size than soy beans, I prefer to utilize smaller angles of endless belt transverse tilt, larger orbital movement diameters, and lower orbital speeds of rotation.

Figure 6:
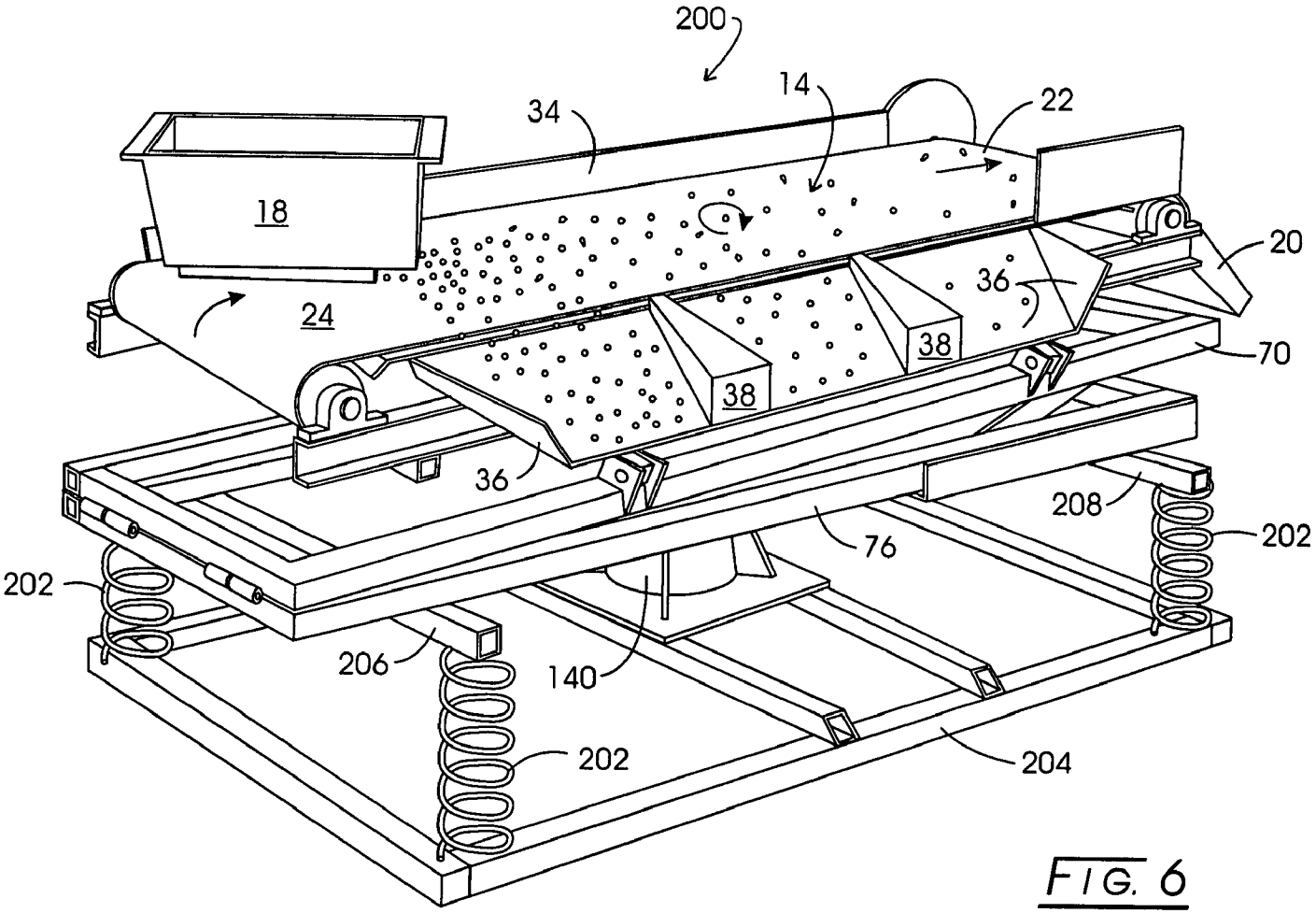
FIG. 6 is a schematic perspective view of alternate embodiment of the present invention having a different type of limited free lateral motion suspension for the invention apparatus compound frame.

In FIG. 6 I schematically illustrate an alternate embodiment of the invention seed sorting endless belt conveyor apparatus. The alternate embodiment is identified generally by reference number 200. Elements corresponding to those of the preferred embodiment are identified by the previously utilized reference numerals. The principal difference between apparatus assembly 10 and apparatus assembly 200 resides in the design of the suspension which facilitates orbital movement of upper and lower longitudinal frame members 70, 76 as a result of operating platform drive mechanism 140. Sorting apparatus 200 utilizes a plurality (i.e., 3 or more) of extended coil springs 202 that are mounted on a weldment-type base frame 204 and that support resiliently mounted, co-operating cross members 206 and 208. Such coil springs have sufficient stiffness in toto to adequately support the apparatus structure carried by cross member 206 and 208, yet are not so rigid as to as to be lacking columnar flexibility that facilitates orbital displacement of the uppermost ends of the coil springs. Operation of the transverse tilt adjustment mechanism 60 and longitudinal tilt adjustment mechanism 100 is identical to the operation of those elements in machine preferred embodiment 10. Similarly, the connection of orbital drive mechanism 140 to the lower longitudinal frame member 76 is the same as in apparatus embodiment 10. Additionally, when orbital drive mechanism 140 is operated both longitudinal frame members 70 and 76 as well as conveyor sub-assembly 14 orbit laterally in the same manner as the like elements of the seed sorting endless belt conveyor apparatus 10 of FIGS. 1 through 5.

Overall, during operation of the invention apparatus "visually" truly spherical soy beans of the preferred premium grade when dumped from feed hopper 18 onto endless conveyor belt 24 quickly roll to the front longitudinal edge of conveyor sub-assembly 14 and onto discharge ramp 36 at the discharge ramp first cut-out zone. Soy beans with less sphericity roll less rapidly toward the conveyor sub-assembly front longitudinal edge and as a result roll into one of the ramp element subsequent cut-out zones thus indicating that they are of less than a "premium" grade. The majority of separate bean elements which do not roll onto second discharge ramp 36 will be carried by endless belt 24 along with other trash to conveyor discharge end 22 and onto first discharge chute 20.

The purpose of superimposing an orbital movement upon the longitudinal movement of endless belt 24 is to quickly insure that all surfaces of the beans or other materials being sorted are more thoroughly examined both for sphericity and for the lack of it as by the presence of flat spots, indentations, etc. Imparting an additional orbital movement too the examined items in addition to the conveyor endless belt longitudinal movement ensures that virtually all surfaces of the items being sorted will be checked. Also, I have discovered that the imposition of orbital motion upon the conveyor endless belt longitudinal motion significantly facilitates the efficient operation of equipment 10 at higher rates of product throughput.

Various changes may be made to the size, shape, and relative proportions of the invention elements described herein without departing from the meaning, scope, or intent of the claims which follow.

I claim:

1. An apparatus assembly for separating grades of food-stuff seeds from a food-stuff seed mixture of premium grade food-stuff seeds and unwanted inferior grade food-stuff seeds, and comprising:

an endless belt conveyor subassembly having an endless belt component, and having a least-elevated end, a most-elevated end, longitudinally upward tilt from said least-elevated end to said most-elevated end, a least elevated longitudinal edge, a most-elevated longitudinal edge spaced apart from said least elevated longitudinal edge, and transversely downward tilt from said most-elevated longitudinal edge to said least-elevated longitudinal edge;

a feed hopper supplying premium grade and inferior grade food-stuff seeds to said endless belt conveyor subassembly least-elevated end;

a first food-stuff seed product discharge ramp positioned adjacent said endless belt conveyor subassembly most-elevated end;

a second food-stuff seed product discharge ramp positioned adjacent said endless belt conveyor subassembly least elevated longitudinal edge;

a longitudinal drive mechanism imparting longitudinal motion to said conveyor endless belt component in a direction from said endless belt conveyor subassembly least-elevated end to said endless belt conveyor subassembly most elevated end; and an orbital drive mechanism superimposing orbital motion upon the longitudinal motion of said endless belt conveyor subassembly endless belt component, whereby premium grade food-stuff seeds are directed to one of said food-stuff seed discharge ramps, and unwanted grade food-stuff seeds are directed to the other of said food-stuff seed product discharge ramps when said longitudinal and orbital drive mechanisms are activated.

2. The invention defined by claim 1, and wherein said feed hopper supplies a mixture of premium grade soy beans and unwanted grade soy beans to said endless belt conveyor subassembly endless belt component, said premium grade soy beans being directed to said second food-stuff seed discharge ramp and said unwanted grade soy beans being directed to said first food-stuff seed discharge ramp when said longitudinal and orbital drive mechanisms are activated.

3. The invention defined by claim 1, and wherein said feed hopper supplies a mixture of black beans and unwanted soy beans to said endless belt conveyor subassembly endless belt component, said soy beans being directed to said second food-stuff seed discharge ramp and said black beans being directed to said first food-stuff seed discharge ramp when said longitudinal and orbital drive mechanisms are activated.

4. The invention defined by claim 1, and wherein said feed hopper supplies a mixture of premium grade garbanzo beans and unwanted grade garbanzo beans to said endless belt conveyor subassembly endless belt component, said premium grade garbanzo beans being directed to said second food-stuff seed discharge ramp and said unwanted grade garbanzo beans being directed to said first food-stuff seed discharge ramp when said longitudinal and orbital drive mechanisms are activated.

5. In an endless belt conveyor apparatus for separating inferior grade food-stuff seeds out of a food-stuff seed mixture having premium grade food-stuff seeds and unwanted inferior grade food-stuff seeds, the improvement comprising:

an upper longitudinal frame member supporting the endless belt conveyor that separates the food-stuff seed mixture into a premium grade food-stuff seed constituent and an unwanted inferior grade food-stuff seed constituent;

a lower longitudinal frame member pivotally supporting said upper longitudinal frame member;

a first tilt adjustment mechanism that controllably pivots said upper longitudinal frame member relative to said lower longitudinal frame member to change the longitudinal tilt of said upper longitudinal frame member and the endless belt conveyor supported thereon;

a first drive mechanism that imparts longitudinal motion to an endless belt component of the endless belt conveyor; and a second drive mechanism that imparts orbital motion to said lower longitudinal frame member and to said upper longitudinal frame member and the conveyor endless belt when activated.

6. The invention defined by claim 5, and wherein said lower longitudinal frame member is supported by a multiplicity of flexible cable segments and thereby made free for limited lateral orbital motion in response to activation of said second drive mechanism.

7. The invention defined by claim 5, and wherein said lower longitudinal frame member supported upon a multiplicity of extended coil springs and thereby made free for limited lateral orbital motion in response to activation of said second drive mechanism.

8. The invention defined by claim 6, and further comprised of a second tilt adjustment mechanism, said second tilt adjustment mechanism being interconnected to the endless belt conveyor and to said upper longitudinal frame member, and said second tilt adjustment mechanism, when activated, causing a change to the transverse tilt of the endless belt conveyor relative to said upper longitudinal frame member.

9. In a method of separating inferior grade food-stuff seeds from a food-stuff seed mixture having premium grade food-stuff seeds and unwanted grade food-stuff seeds the steps of:

a. Flowing the mixture onto a moving endless conveyor belt having longitudinal belt motion, having a longitudinal upward tilt in the direction of said longitudinal belt motion, and having transverse downward tilt at right angles to the direction of said longitudinal belt motion;

b. Superimposing an orbital motion on said moving endless conveyor belt that is in addition to said longitudinal belt motion;

c. Discharging the premium grade seeds of the food-stuff seed mixture from upon said endless conveyor belt into one or more collection zones positioned at the edge of said moving endless conveyor belt at its lowermost regions of transverse downward tilt; and d. Discharging the unwanted grade seeds of the food-stuff seed mixture from upon said endless conveyor belt into one or more collection zones positioned at the end of said moving endless conveyor belt at its uppermost regions of longitudinal upward tilt.

10. The method invention defined by claim 9, and wherein said food-stuff seed mixture is a mixture of spherically-imperfect soy bean seeds and spherically near-perfect "premium" soy bean seeds.

11. The method invention defined by claim 9, and wherein said endless conveyor belt longitudinal upward tilt is approximately 4¼°.

12. The method invention defined by claim 9, and wherein said endless conveyor belt transverse downward tilt is approximately 3½°.

13. The method invention defined by claim 9, and wherein said superimposed orbital motion is developed with an average diameter of approximately 3½ inches and a rotational speed of approximately 70 to 80 revolutions per minute.

14. The method invention defined by claim 9, and wherein said food-stuff seed mixture is a mixture of soy bean seeds and black bean seeds, and further wherein said soy bean seeds are discharged from said endless conveyor belt from along said lowermost regions of transverse tilt and said black bean seeds are discharged from said endless conveyor belt from along said uppermost regions of its longitudinal upward tilt.

* * * * *